US011691793B2

(12) United States Patent
Hice et al.

(10) Patent No.: US 11,691,793 B2
(45) Date of Patent: Jul. 4, 2023

(54) CONTAINER WITH LATCH

(71) Applicant: Promontory Holdings, LLC, Oakland, CA (US)

(72) Inventors: Austin Hice, Oakland, CA (US); Ganesh Patgar, South Yarra (AU)

(73) Assignee: Promontory Holdings, LLC, Culver City, CA (US)

( * ) Notice: Subject to any disclaimer, the term of this patent is extended or adjusted under 35 U.S.C. 154(b) by 394 days.

(21) Appl. No.: 16/222,560

(22) Filed: Dec. 17, 2018

(65) Prior Publication Data

US 2020/0189812 A1 Jun. 18, 2020

(51) Int. Cl.
*B65D 50/04* (2006.01)
*B65D 43/16* (2006.01)

(52) U.S. Cl.
CPC ..... *B65D 50/04* (2013.01); *B65D 43/164* (2013.01); *B65D 2215/02* (2013.01)

(58) Field of Classification Search
CPC ..... B65D 50/04; B65D 50/02; B65D 50/00; B65D 50/06; B65D 50/045; B65D 50/046; B65D 43/164; B65D 2215/02; B65D 2215/04; B65D 2215/00
See application file for complete search history.

(56) References Cited

U.S. PATENT DOCUMENTS 4,048,051 A * 9/1977 Gretz ..... A45C 13/10 206/1.5
4,174,034 A 11/1979 Hoo
4,219,116 A * 8/1980 Borkan ..... B65D 50/045 206/1.5
4,576,307 A 3/1986 Frydenberg
4,615,464 A * 10/1986 Byrns ..... B29C 49/0031 16/341
5,887,736 A * 3/1999 Mar ..... B65D 50/045 215/213
6,655,544 B1 * 12/2003 Tanaka ..... B65D 43/22 220/835
7,370,773 B2 5/2008 Toth et al.
8,550,281 B2 10/2013 Williamson
8,590,734 B2 11/2013 Giraud
9,266,649 B1 2/2016 Mar
2009/0114653 A1 * 5/2009 Schenker ..... B65D 45/02 220/324

(Continued)

OTHER PUBLICATIONS amazon.com; "All in One Clear Plastic Storage Container with Slide Lock 14.5×10×3.5 cm"; Amazon ASIN B015IRUP54; screen Capture of web page downloaded Sep. 4, 2018.

*Primary Examiner* — Javier A Pagan
(74) *Attorney, Agent, or Firm* — Hawkinson Yang LLP

(57) ABSTRACT

A container assembly includes a first portion including a first latch portion; and a second portion including a second latch portion. The first and second portions are configured to be movable between an open configuration and a closed configuration, and the first and second latch portions are configured to releasably engage in the closed configuration. The first and second latch portions are configured to engage the first and second container portions together in the closed configuration to define an internal compartment. The second latch portion includes a latch cage defining a chamber configured to receive a portion of the first latch portion in the closed configuration.

9 Claims, 11 Drawing Sheets

(56) References Cited

U.S. PATENT DOCUMENTS

| | | | | |
|---|---|---|---|---|
| 2009/0127156 | A1* | 5/2009 | Tung | B65D 83/0463<br>206/531 |
| 2009/0200307 | A1* | 8/2009 | Giraud | B65D 50/04<br>220/326 |
| 2016/0039581 | A1* | 2/2016 | Mar | B65D 50/06<br>215/216 |
| 2018/0086518 | A1* | 3/2018 | Charm | B65D 43/26 |

* cited by examiner

CONTAINER WITH LATCH

BACKGROUND

The present invention relates generally to containers. More particularly, the present invention relates to a container having a latch mechanism.

Containers are used to hold various objects including, but not limited to, various things that might pose a safety/health hazard to young children. Child-resistant packaging, also known as "special packaging," is used to reduce the risk of poisoning in children via the ingestion of potentially hazardous items including certain prescription and over-the-counter medications, pesticides, and household chemicals. The U.S. Consumer Product Safety Commission has the authority to regulate child-resistant packaging via the Poison Prevention Packaging Act (PPPA). According to the PPPA, the term "special packaging" means packaging that is designed or constructed to be significantly difficult for children under five years of age to open or obtain a toxic or harmful amount of the substance contained therein within a reasonable time and not difficult for normal adults to use properly, but does not mean packaging which all such children cannot open or obtain a toxic or harmful amount within a reasonable time. For safety reasons, containers have been designed to prevent or limit access by unsupervised young children in order to reduce the opportunity for children ingest the contents of these containers, and therefore reduce the chances that a child will be poisoned or otherwise suffer potentially life-threatening ill-effects. Different types of containers have been proposed to store items, including containers identified as being "child resistant" or "child proof." However, such containers have their limitations and can always be improved.

Accordingly, there is a need for an improved container in the form of a container assembly. There is a further need for a container having a feature to prevent jamming of a latch mechanism. There is also a need for a container that does not require additional fasteners to connect a latch mechanism. There is a further need for a container that provides a latch mechanism that is child resistant. There is an additional need for a container that is easier to manufacture, assemble, adjust, and maintain. The present invention satisfies these needs and provides other related advantages.

SUMMARY

The container assembly illustrated herein provides an improved container. The container assembly illustrated herein provides an improved container assembly for preventing jamming of a latch assembly. The container assembly illustrated herein further provides an improved container assembly for attaching a latch mechanism. The container assembly illustrated herein further provides a latch mechanism that is child resistant. The container assembly illustrated herein provides a container assembly that is easier to manufacture, assemble, adjust, and maintain.

In an illustrative embodiment, a container assembly includes a first portion including a first latch portion; and a second portion including a second latch portion. The first and second portions are configured to be movable between an open configuration and a closed configuration, and the first and second latch portions are configured to releasably engage in the closed configuration. The first and second latch portions are configured to engage the first and second container portions together in the closed configuration to define an internal compartment. The second latch portion includes a latch cage defining a chamber configured to receive a portion of the first latch portion in the closed configuration.

In a further illustrative embodiment, the portion of the first latch portion includes a latch member configured to engage a portion of the second latch portion within the latch cage when the second latch portion is in an engagement position.

In an additional illustrative embodiment, the second latch portion includes a pair of biasing arms configured to engage a portion of the second portion, and bias the second latch portion to an engagement position.

In a further illustrative embodiment, the second latch portion is configured to be slideably moveable in a first direction between the engagement position and a first disengagement position when the first and second portions are in the closed configuration.

In yet another illustrative embodiment, the second latch portion is configured to be slideably moveable in a second direction between the engagement position and a second disengagement position when the first and second portions are in the closed configuration, wherein the second direction is opposite the first direction.

In an additional illustrative embodiment, the second latch portion is configured to be slideably moveable between a first position and a second position when the first and second portions are in the closed configuration, whereby the second latch portion engages the first latch portion in the first position, thereby holding the first and second portions in the closed configuration, and the second and first latch portions are disengaged in the second position, thereby allowing the first and second portions to move from the closed configuration to the open configuration.

In yet a further illustrative embodiment, the first latch portion is configured to be moveable between a first position and a second position when the first and second portions are in the closed configuration, whereby the first latch portion engages the second latch portion in the first position, thereby holding the first and second portions in the closed configuration.

In an additional illustrative embodiment, the first and second latch portions are disengaged in the second position of the first latch portion when the second latch portion is moved from a first position of the second latch portion, wherein the first and second latch portions are engaged, to a second position of the second latch portion, wherein the first and second latch portions are disengaged, thereby allowing the first and second portions to move from the closed configuration to the open configuration.

In another illustrative embodiment, the first latch portion directly mechanically engages the first portion without additional fasteners.

In still another illustrative embodiment, the second latch portion directly mechanically engages the second portion without additional fasteners.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The various present embodiments now will be discussed in detail with an emphasis on highlighting the advantageous features with reference to the drawings of various embodiments. The illustrated embodiments are intended to illustrate, but not to limit the invention. These drawings include the following figures, in which like numerals indicate like parts.

DETAILED DESCRIPTION

Figure 1:
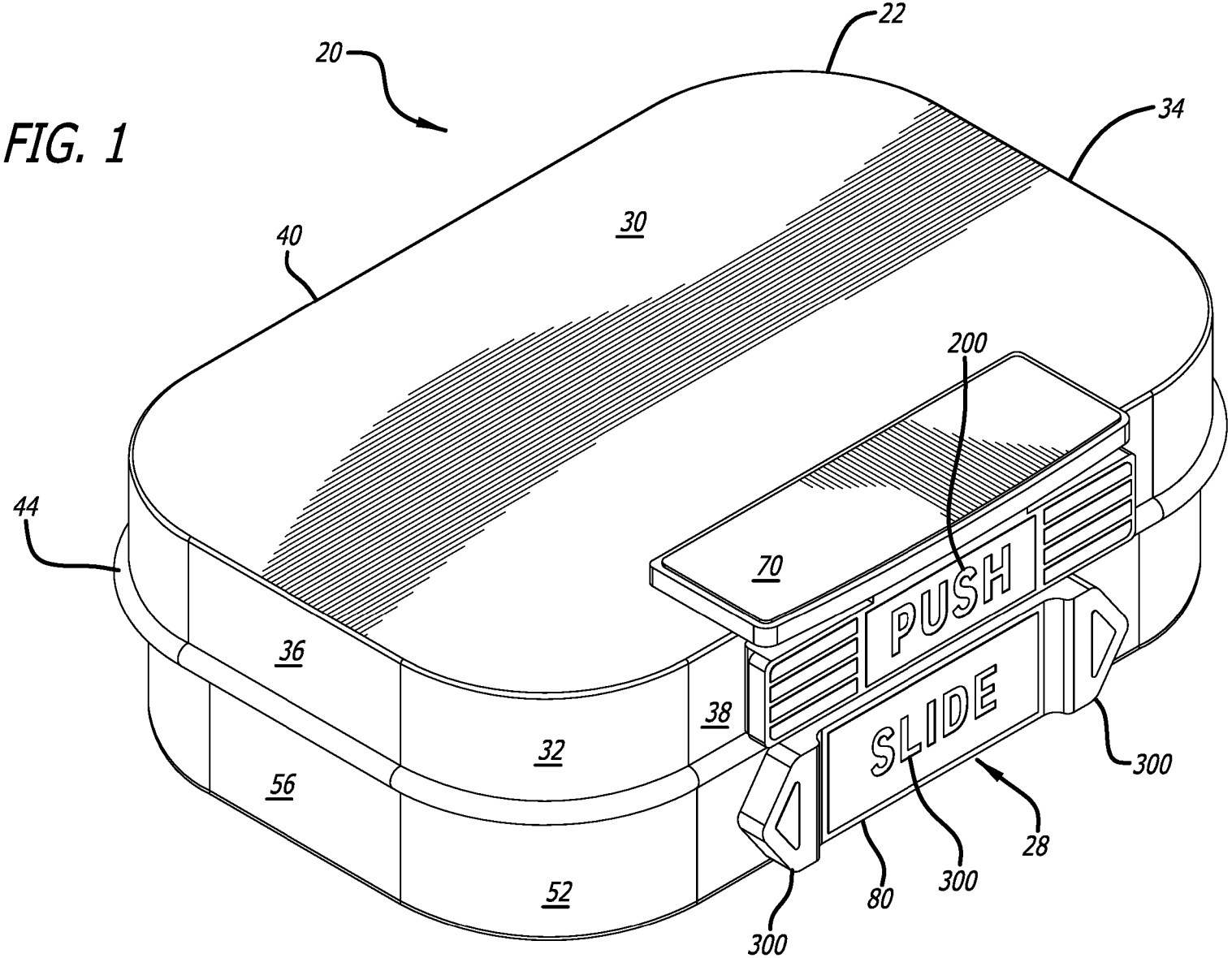
FIG. 1 illustrates an upper front, left perspective view of a container assembly in a closed configuration, in accordance with an embodiment of the present invention.
Figure 2:
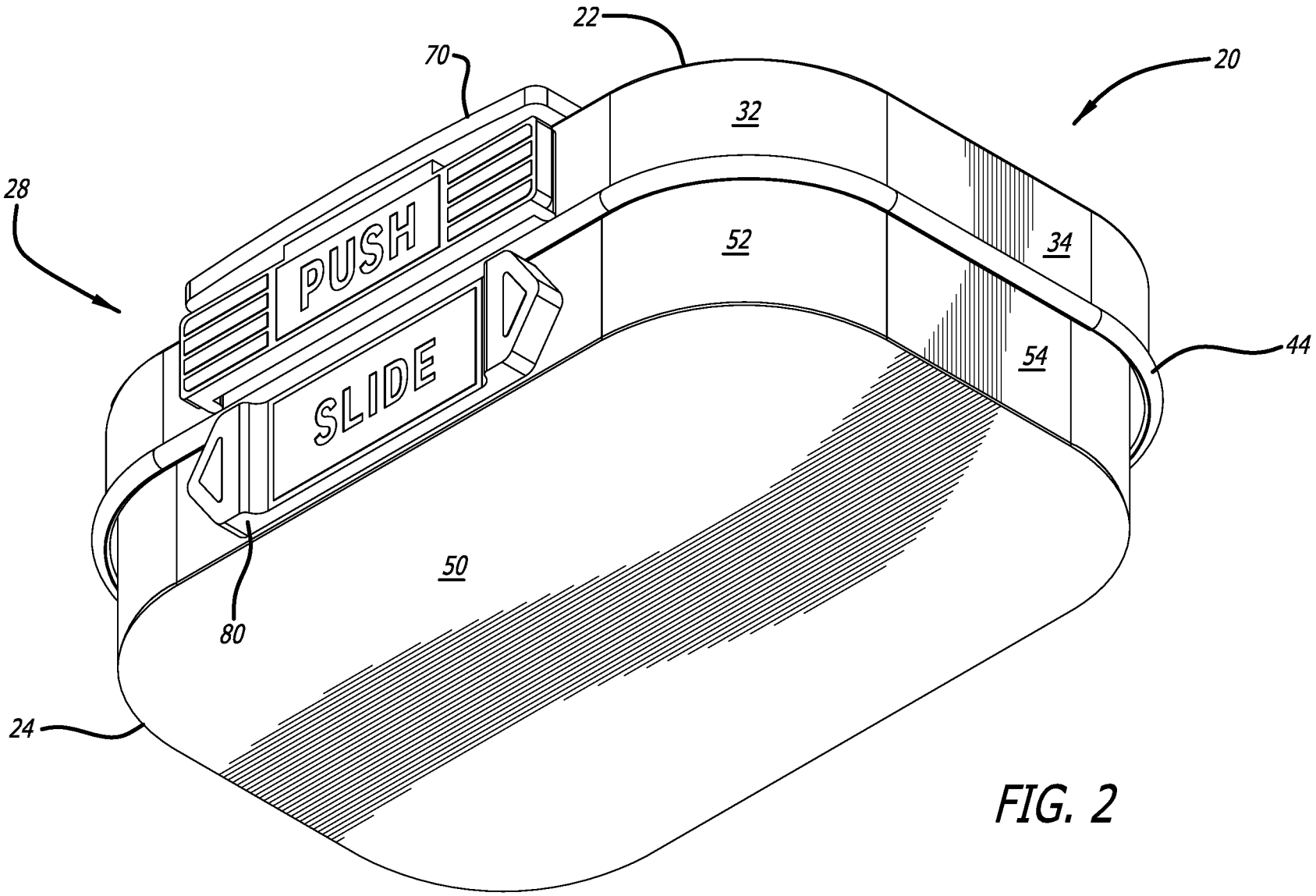
FIG. 2 illustrates a lower, front, right perspective view of the container assembly of FIG. 1.
Figure 3:
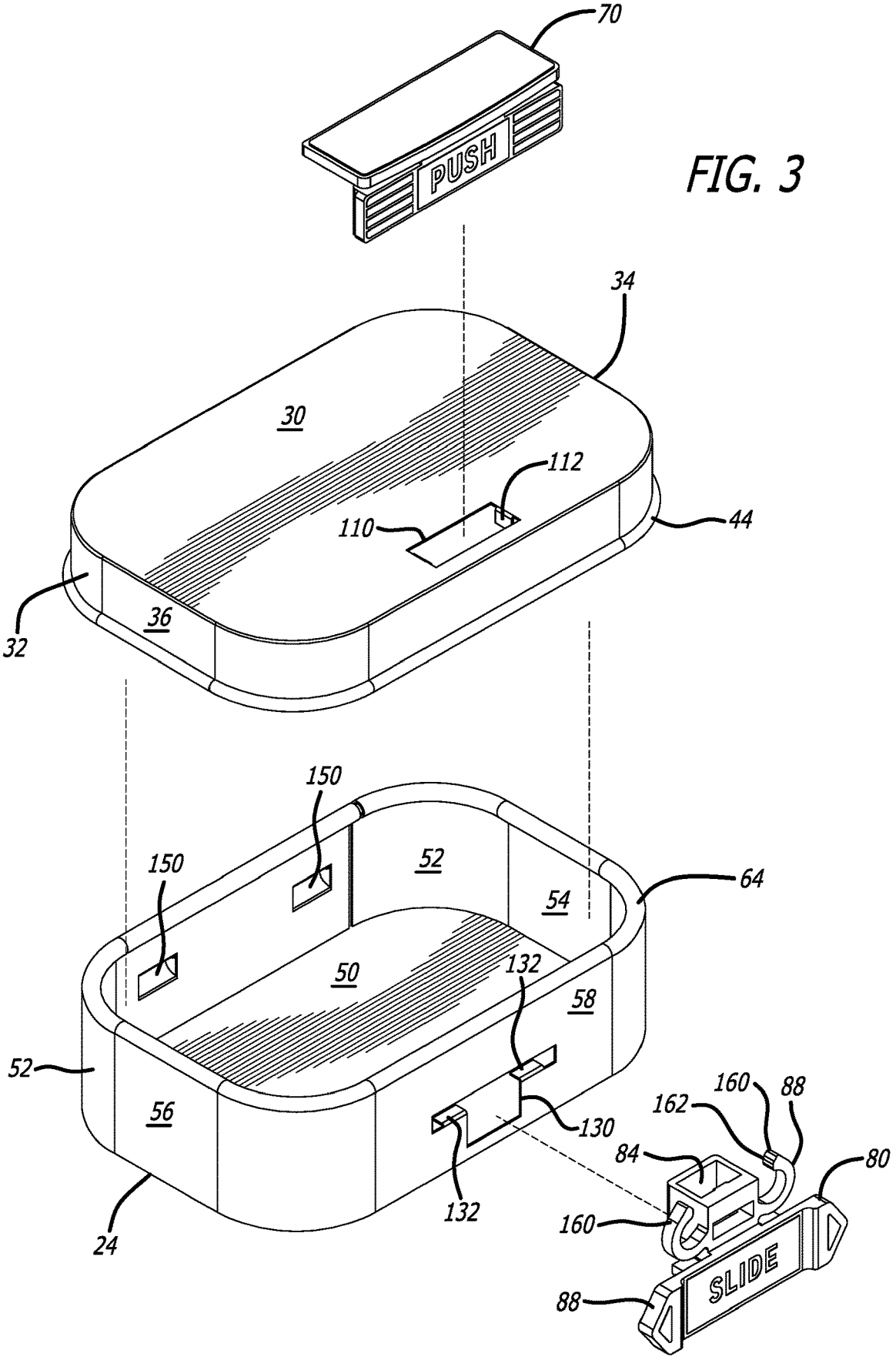
FIG. 3 illustrates an exploded, perspective view of the container assembly of FIG. 1.
Figure 4:
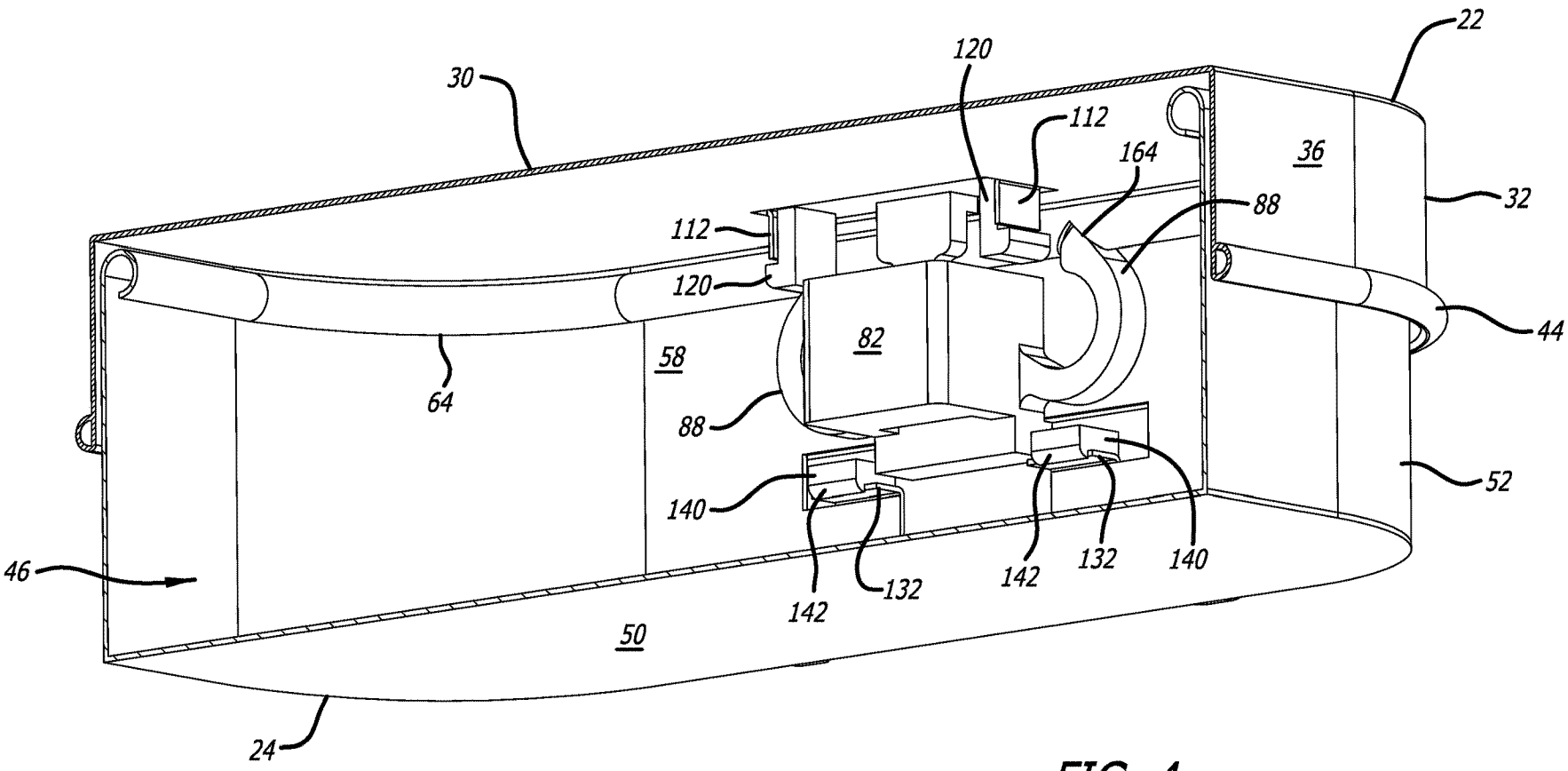
FIG. 4 illustrates a cut-away view of the container assembly of FIG. 1, showing an interior compartment and a latch mechanism engaging a lid and a base of the container assembly.

The following detailed description describes present embodiments with reference to the drawings. In the drawings, reference numbers label elements of present embodiments. These reference numbers are reproduced below in connection with the discussion of the corresponding drawing features.

It is to be understood that the figures and descriptions of the present invention have been simplified to illustrate elements that are relevant for a clear understanding of the present invention, while eliminating, for the purpose of clarity, many other elements found in container assemblies. Those of ordinary skill in the pertinent arts may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the pertinent arts.

As shown in FIGS. 1-12 for purposes of illustration, an embodiment of the present invention resides in a container assembly 20 including a first container portion, first portion, or lid portion 22, and a second container portion, second portion, or base portion 24. The lid and base portions 22, 24 of the container assembly 20 are configured to be moveable between an open configuration and a closed configuration. The lid and base portions 22, 24 hingedly engage each other, and are rotatable relative to one another between the closed configuration and the open configuration. The lid and base portions 22, 24 are hingedly connected by a hinge mechanism 26. The container assembly 20 further includes a latch mechanism 28 for retaining the lid and base portions 22, 24 in the closed configuration. The container assembly 20 is generally rectangular in shape with generally curved corners. Engagement of the lid and base portions 22, 24 in the closed configuration define an internal compartment 46 within the container assembly 20. The container assembly 20 can be used to hold various objects including, but not limited to, vitamins, nutraceuticals, nutritional supplements, candies, breath mints, pain relievers (e.g., analgesics such as acetaminophen, ibuprofen, or the like), medications (in various forms including capsules, tablets, or the like), or other things containing ingredients intended to have a medicinal or psychoactive effect (e.g., an edible containing cannabis including, without limitation, candies, baked goods, and the like).

The lid portion 22 includes a generally rectangular, generally planar (preferably generally flat) top portion 30. The lid portion 22 also includes four (4) generally curved corner portions 32, and four (4) generally vertical, generally planar wall portions 34, 36, 38, 40. The top portion 30, corner portions 32, and wall portions 34, 36, 38, 40 are integrally formed of single-piece construction to define the lid portion 22 and a storage section 42 therein. The corner and wall portions 32, 34, 36, 38, 40 have the same vertical length. Alternative, one or more of the top portion 30, corner portions 32, and wall portions 34, 36, 38, 40 may be separately formed and then joined together to define the lid portion 22. A curved lip 44 extends outwardly from a lower end of the corner and wall portions 32, 34, 36, 38, 40 along a lower periphery of the lid portion 22.

The base portion 24 includes a generally rectangular, generally planar (preferably generally flat) bottom portion 50. The base portion 24 also includes four (4) generally curved corner portions 52, and four (4) generally vertical, generally planar wall portions 54, 56, 58, 60. The bottom portion 50, corner portions 52, and wall portions 54, 56, 58, 60 are integrally formed of single-piece construction to define the base portion 24 and a storage section 62 therein. The corner and wall portions 52, 54, 56, 58, 60 of the base portion 24 have the same vertical length. Alternative, one or more of the bottom portion 50, corner portions 52, and wall portions 54, 56, 58, 60 may be separately formed and then joined together to define the base portion 24. A curved lip 64 extends inwardly from an upper end of the corner and wall portions 52, 54, 56, 58, 60 along an upper periphery of the base portion 24.

In the closed configuration, the lid portion 22 is disposed on top of the base portion 24. The vertical lengths of the corner and wall portions 32, 34, 36, 38, 40 of the lid portion 22 are less than or equal to about half the vertical length of the corner and wall portions 52, 54, 56, 58, 60 of the base portion 24. The lip 44 of the lid portion 22 is disposed about the corner and wall portions 52, 54, 56, 58, 60 of the base portion 24 at least halfway or more up the vertical length of the corner and wall portions 52, 54, 56, 58, 60 of the base portion 24.

The latch mechanism 28 includes a first latch portion or push portion 70, and a second latch portion or slide portion 80. The push portion 70 engages the first portion or lid portion 22, and the slide portion 80 engages the second portion or base portion 24. The push and slide portions 70, 80 are configured to releasably engage each other when the container assembly 20 is in the closed configuration, and thereby hold the lid and base portions 22, 24 in the closed configuration when the push and slide portions 70, 80 are engaged.

Figure 5:
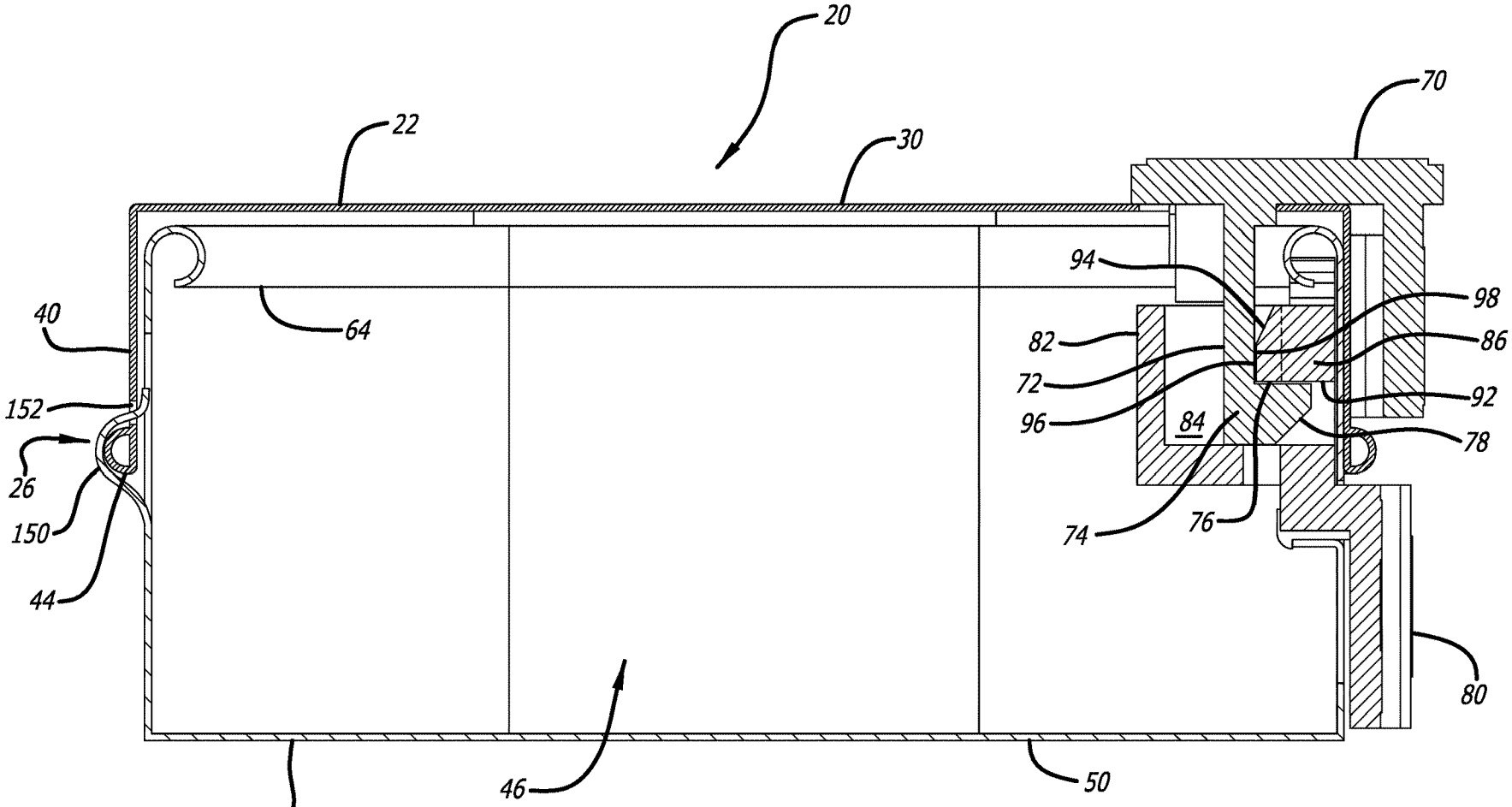
FIG. 5 illustrates a side, cross-sectional view of the container assembly of FIG. 1, with a push portion in a first or resting position.
Figure 6:
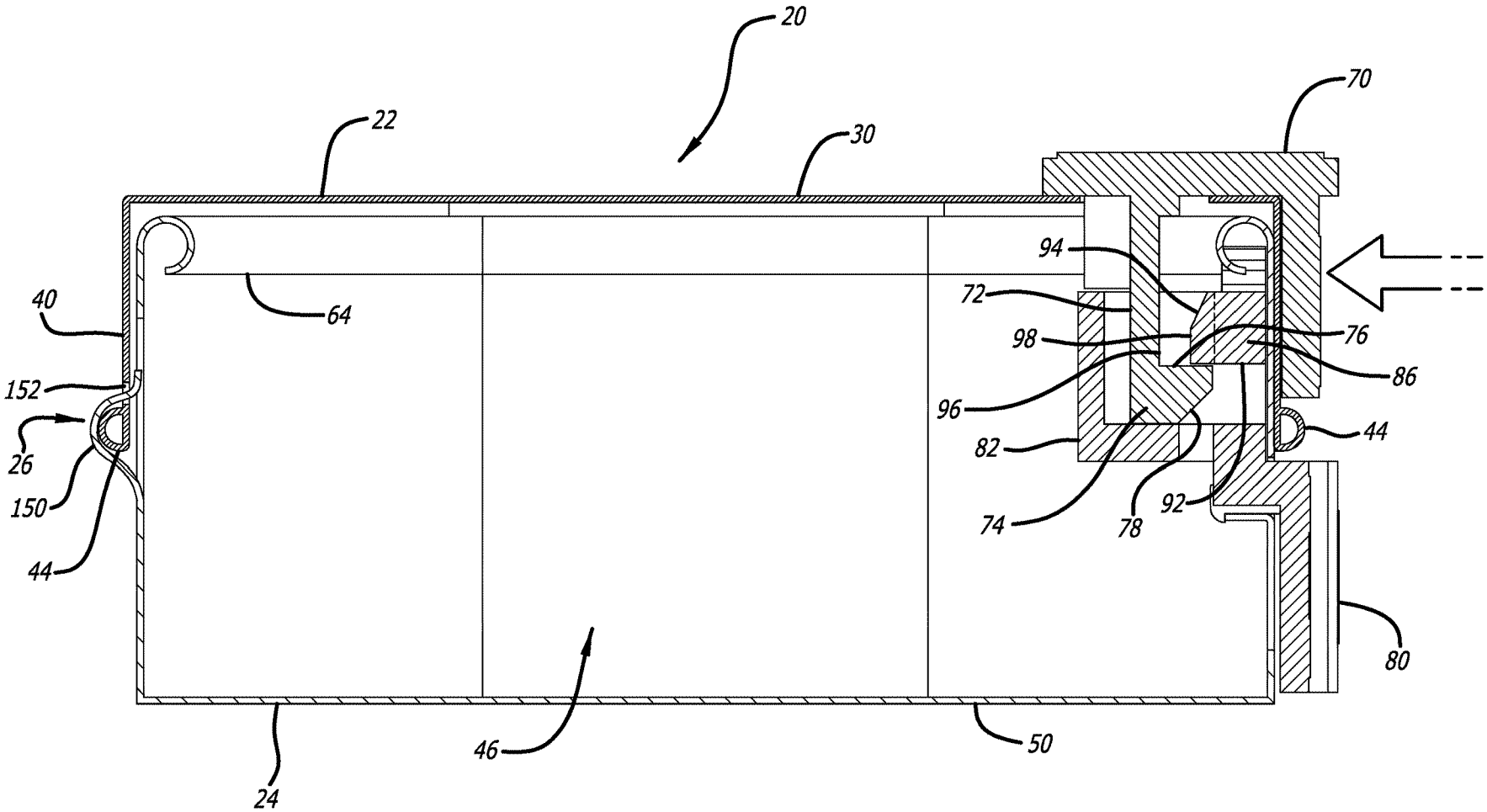
FIG. 6 illustrates a side, cross-sectional view of the container assembly of FIG. 1, with a push portion in a second or depressed position, with an arrow indicating the direction of force applied to the push portion.
Figure 7:
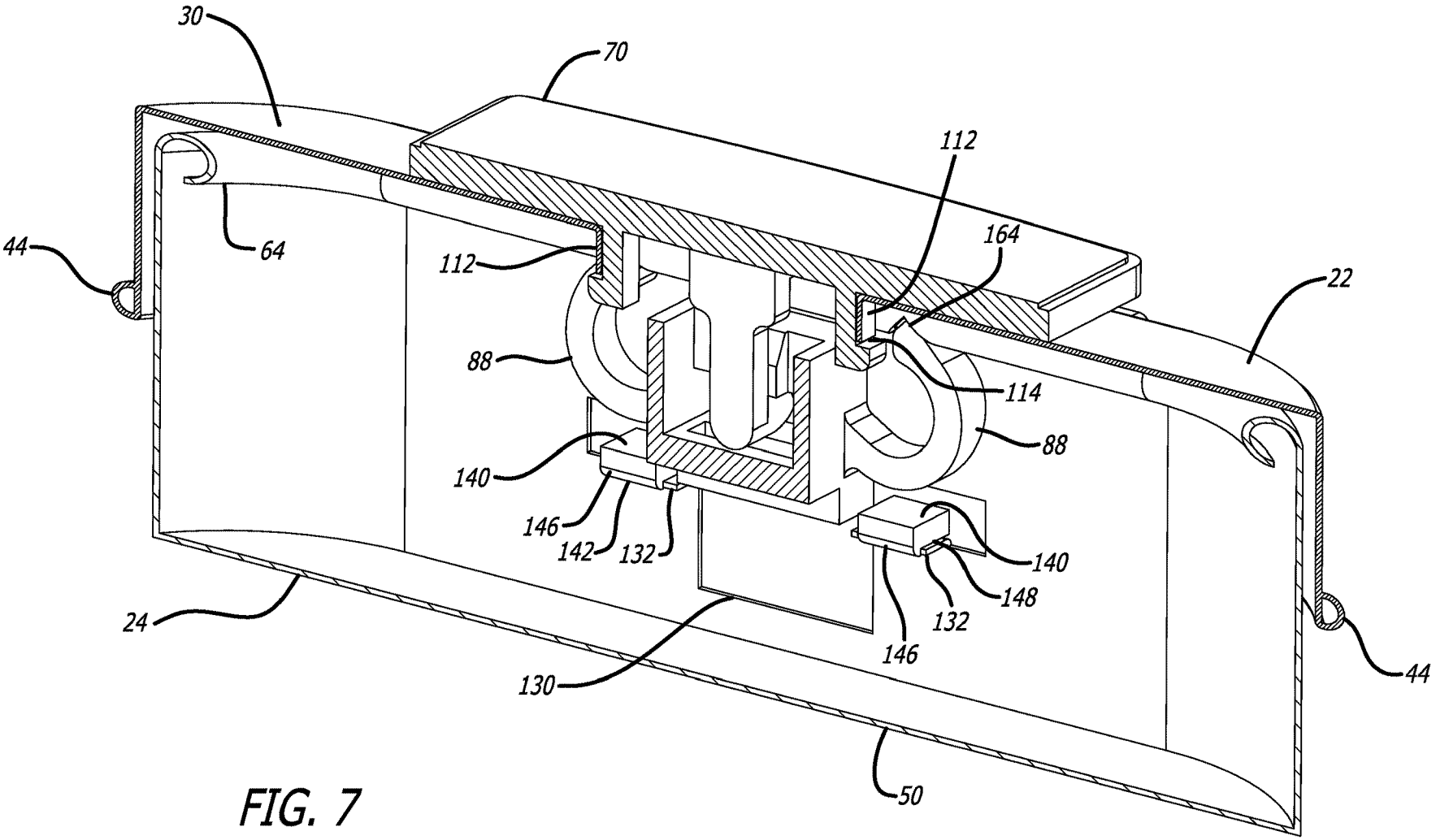
FIG. 7 illustrates a cross-sectional view of the container assembly of FIG. 1, showing engagement of the push and slide portions of the latch mechanism in the first or resting position.

The slide portion 80 includes a latch cage 82 defining a chamber 84 configured to receive a push latch member 72 of the push portion 70 in the closed configuration. The push latch member 72 has a wedge-shaped head portion 74. An upper, generally flat portion 76 of the wedge-shaped head portion 74 of the push latch member 72 is configured to engage a lower, generally flat portion 92 of a slide latch wedge 86 of the slide portion 80 in the closed configuration when the slide portion 80 is in a latch member engagement position, as seen in FIGS. 5 and 7. When the lid portion 22 is moved from the open configuration to the closed configuration, the push latch member 72 enters the chamber 84 of the latch cage 82, and an angled portion 78 of the push latch member 72 contacts an angled portion 94 of the slide latch wedge 86. Contact between these angled portions 78, 94 as the lid portion 22 is moving into the closed configuration, biases the push portion 70, along with the push latch member 72, backwards as the push latch member 72 moves downwards. When the upper, generally flat portion 76 of the wedge-shaped head portion 74 moves just under the lower, generally flat portion 92 of the slide latch wedge 86, the push portion 70 is biased forwards until a generally vertical portion 96 of the wedge-shaped head portion 74 contacts a generally vertical portion 98 of the slide latch wedge 86, and allows no further forward movement of the push latch member 72. At this point, the positions of the upper, generally flat portion 76 of the wedge-shaped head portion 74 and the lower, generally flat portion 92 of the slide latch wedge 86 prevent upward movement of the push latch member 72, and therefore allow prevent upward movement of the lid portion 22.

The slide portion 80 also includes a pair of biasing arms or slide springs 88 configured to engage a portion of the base portion 24, and bias the slide portion 80 to an engagement position. Each slide spring 88 has a head portion configured to engage a portion of the lip 64 of the base portion 24 in that a top portion of each slide spring 88 is sized and shaped to engage the lip 64. There are two (2) grooves 164 in a bottom portion of the lip 64 of the base portion 24. A head portion 160 of each slide spring 88 that is sized and shaped to engage the grooves 164 such that, when the slide portion 80 is slid to the left or to the right away from a center position by the user exerting force to move the slide portion 80, the slide springs 88 exert force to re-center the slide portion 80. The head portion 160 also includes ridges 162 that engage the surface of the grooves 164. The force exerted by the slide springs 88 pushing the head portions 160 against the lip 64, and engagement of the ridges 162 and grooves 164 of the lip 64 is enough force to hold the head portions 160 generally in place as the slide springs resiliently deforms as the slide portion 80 is slide to the left or to the right away from the center position (see FIG. 8). The grooves 164 may be various shapes including, but not limited to, V-shaped grooves, U-shaped grooves. Alternatively, a pair of slits may be made in the bottom portion of the lip 64 and each slit configured to engage the head portion 160 of one of the slide springs 88.

The slide portion 80 is configured to be slideably moveable in a first direction (e.g., to the left) between the latch member engagement position and a first latch member disengagement position when the lid and base portions 22, 24 are in the closed configuration. Each slide spring 88 is resilient, such that when the slide portion 80 is slideably moved in the first direction, the spring load in the resilient slide springs 88, pulls the side portion 80 in a second direction opposite the first direction (i.e., the slide springs 88 pull the slide portion 80 to the right). This has the effect of re-centering the slide portion 80 in the latch member engagement position once the lateral force applied to the slide portion 80 by the user to slide the slide portion 80 in the first direction is no longer applied.

The slide portion 80 is also configured to be slideably moveable in the second direction (e.g., to the right) between the latch member engagement position and a second latch member disengagement position when the lid and base portions 22, 24 are in the closed configuration, wherein the second direction is opposite the first direction. Again, as each slide spring 88 is resilient, such that when the slide portion 80 is slideably moved in the second direction, the spring load in the resilient slide springs 88, pulls the side portion 80 in the first direction (i.e., the slide springs 88 pull the slide portion 80 to the left). Again, this has the effect of re-centering the slide portion 80 in the latch member engagement position once the lateral force applied to the slide portion 80 by the user to slide the slide portion 80 in the second direction is no longer applied.

The slide portion 80 is configured to be slideably moveable in both a first direction and a second direction (e.g., in both right and left directions) when the lid and base portions 22, 24 are in the closed configuration. The slide portion 80 engages the push portion 70 in the latch member engagement position, thereby holding the lid and base portions 22, 24 in the closed configuration, and the push and slide portions 70, 80 are disengaged in either the first or second latch member disengagement positions, thereby allowing the lid and base portions 22, 24 to move from the closed configuration to the open configuration. In the first or second latch member disengagement positions, the push latch member 72 is disengaged from the slide latch wedge 86; allowing the lid portion 22 to be rotated away from the base portion 24 into the open configuration.

The push portion 70 is configured to be moveable between a first latch member position and a second latch member position (see FIGS. 5 and 6) when the lid and base portions 22, 24 are in the closed configuration, whereby the latch member 72 of the push portion 70 engages the slide latch wedge of the slide portion 80 in the first latch member position, thereby holding the lid and base portions 22, 24 in the closed configuration. The latch member 72 continues to engage the slide latch wedge 86 in the second latch member position when the slide portion 80 is in the latch member engagement position. The latch member 72 is disengaged from the slide latch wedge 86 when the slide portion 80 is moved to either the first or second latch member disengagement positions.

Figure 8:
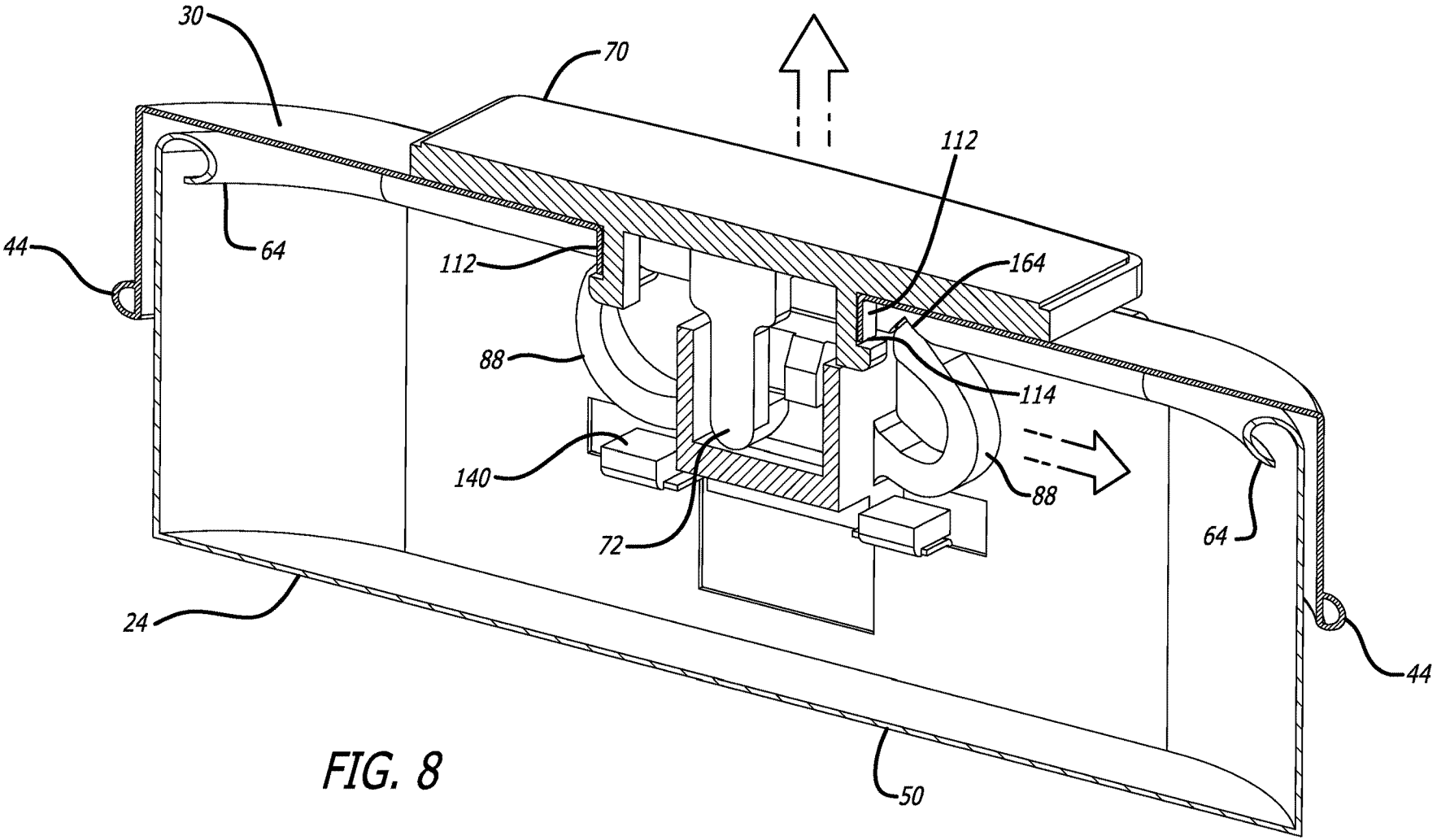
FIG. 8 illustrates a cross-sectional view of the container assembly of FIG. 1, showing engagement of the push and slide portions of the latch mechanism in the second or depressed position with a lateral, rightward arrow indicating the direction to which force and the direction of movement of the slide portion, and a longitudinal, arrow indicating the direction of force and the direction of movement of the push portion.
Figure 9:
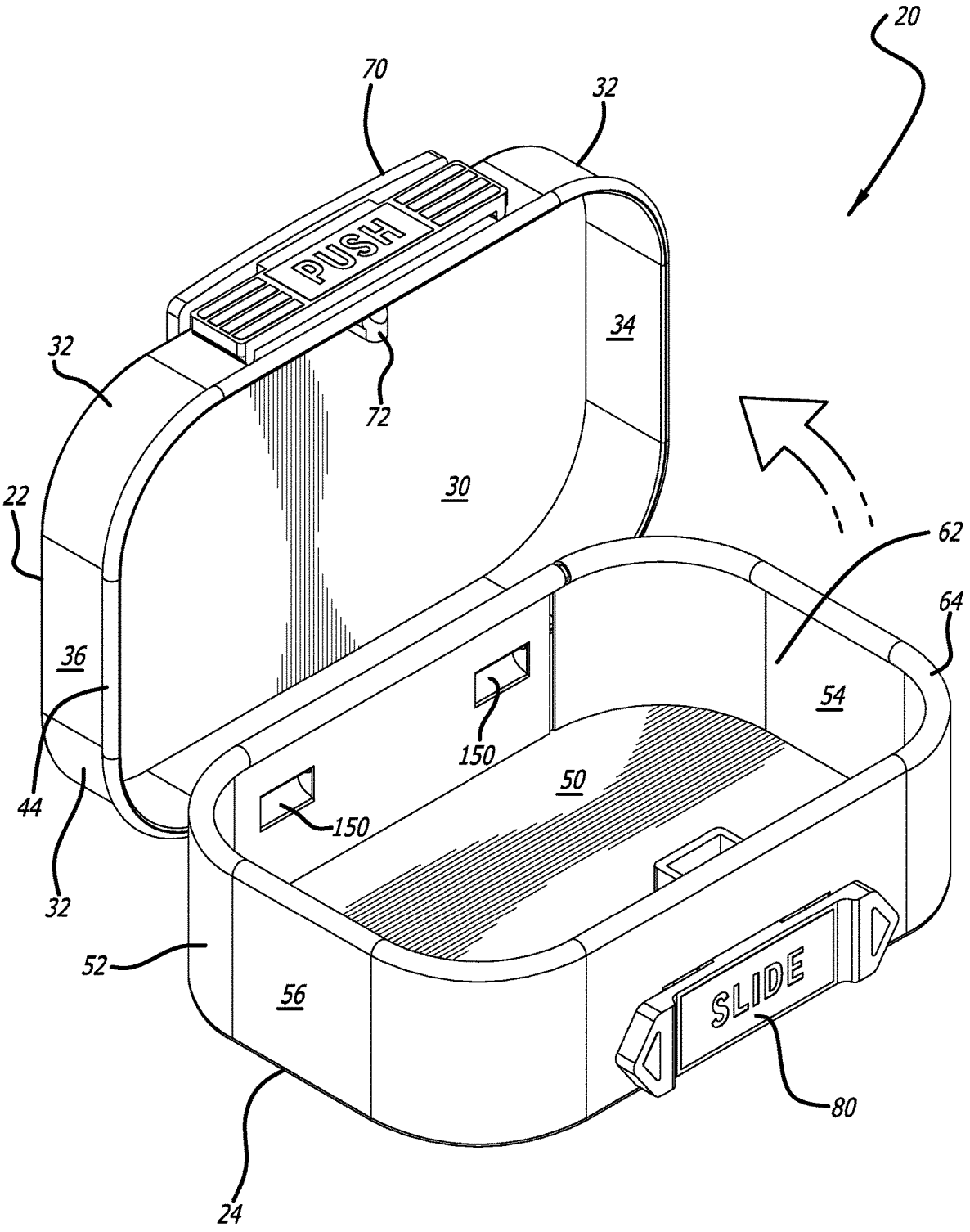
FIG. 9 illustrates an upper front, left perspective view of the container assembly of FIG. 1 in an open configuration, with an arrow indicating the direction of rotational movement of the lid from the closed configuration to the open configuration.
Figure 10:
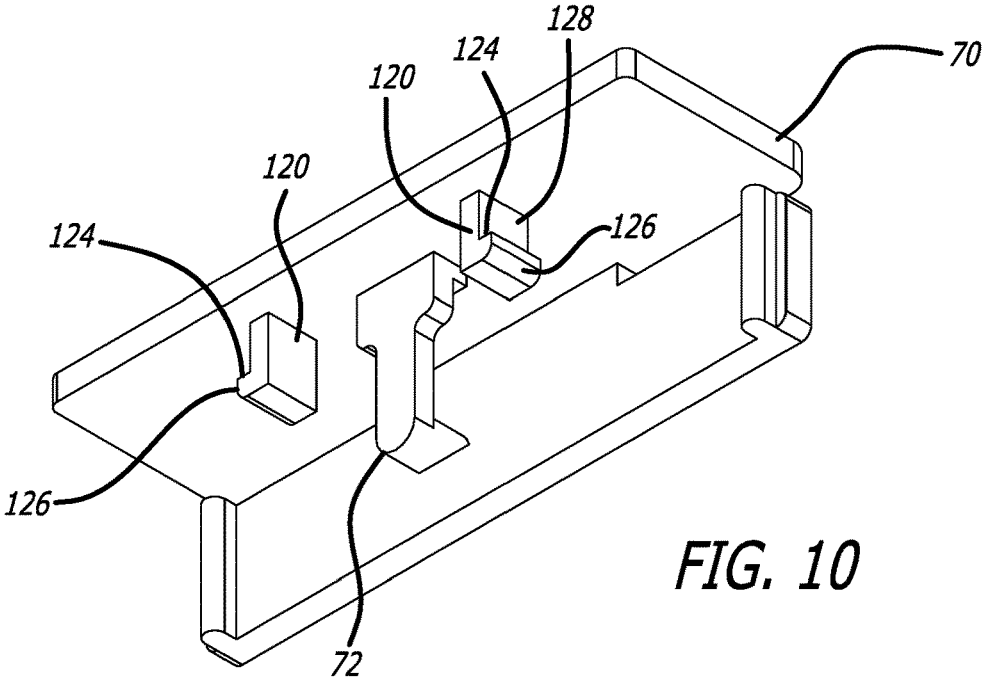
FIG. 10 illustrates a lower, rear, right perspective view of the push portion of the latch mechanism.
Figure 11:
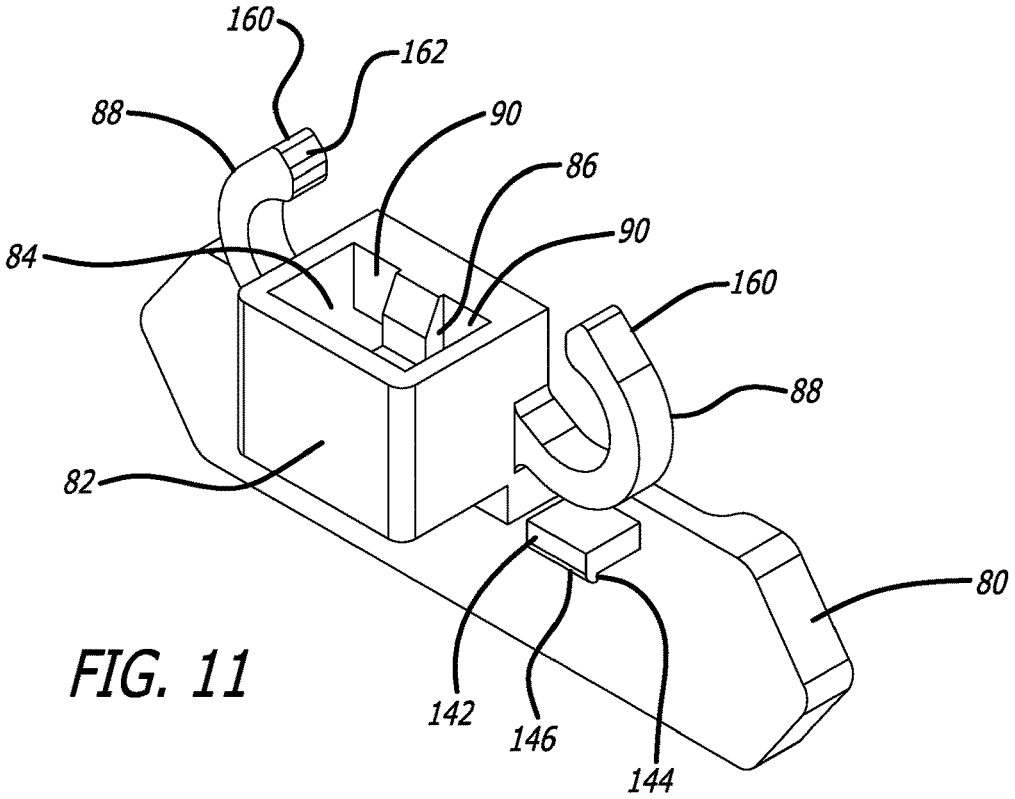
FIG. 11 illustrates an upper, rear, right perspective view of the slide portion of the latch mechanism.
Figure 12:
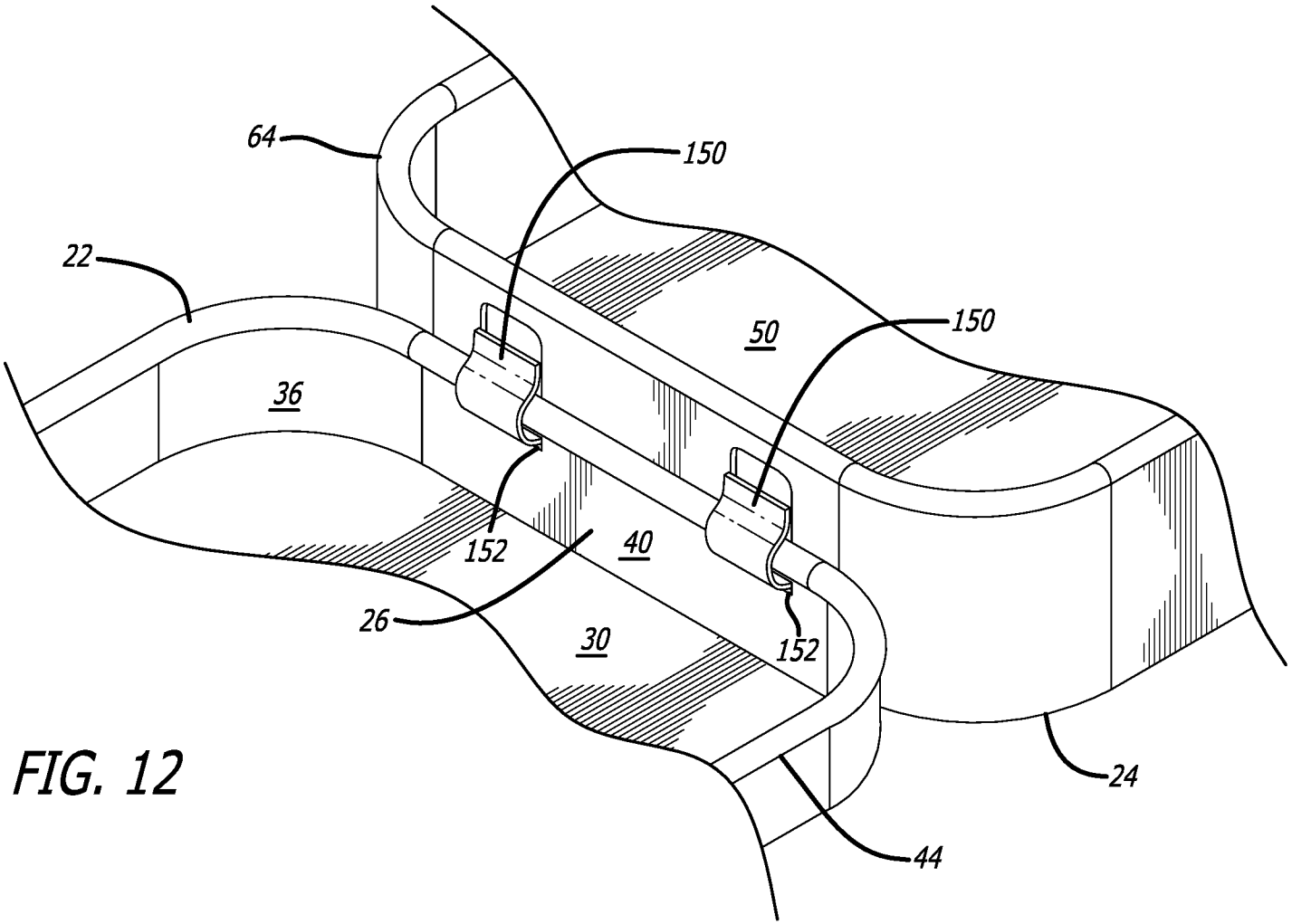
FIG. 12 illustrates the hinge mechanism of the container assembly of FIG. 1, with the container assembly in a fully open configuration.

The push and slide portions 70, 80 are disengaged in the second latch member position of the push portion 70 when the slide portion 80 is moved from the latch member engagement position, wherein the push and slide portions 70, 80 are engaged, to the latch member disengagement, wherein the push and slide portions 70, 80 are disengaged, thereby allowing the lid and base portions 22, 24 to move from the closed configuration to the open configuration (see FIGS. 7 and 8). As seen in FIG. 11, there is a space 90 to either side of the slide latch wedge 86. When the slide portion 80 is moved from the latch member engagement position to either the first or second latch member disengagement positions, the latch member 72 remains stationary while the slide latch wedge 86 moves to the left or the right, depending on the direction the slide portion 70 is moved, leaving the latch member 72 now aligned with the space 90, and disengaged from the slide latch wedge 86.

The push portion 70 directly mechanically engages the lid portion 22 without additional fasteners. That is, the push portion 70 engages the lid portion 22 without the use of various additional fasteners including, but not limited to, mechanical fasteners (e.g., screws, nuts, washers, bolts, or the like), chemical fasteners (e.g., adhesives, or the like) or other types of fastening (e.g., laser welding, or the like). The lid portion 22 include a generally rectangular opening 110 in the top portion 30 through which the push latch member 72 and a pair of lid-engaging latch members 120 may be inserted. The lid portion 22 further includes a pair of generally vertical flanges 112. Each lid-engaging latch member 120 includes a wedge-shaped head portion 122. An upper, generally flat portion 124 of each wedge-shaped head portion 122 is configured to engage a lower edge 114 of one of the generally vertical flanges 112, as seen in FIGS. 4-8. When the lid-engaging latch members 120 pass through the opening 110, an angled portion 126 of each lid-engaging latch member 120 contacts a side of one of the generally vertical flanges 112. Contact between the angled portion 126 and the generally vertical flange 112 biases the wedge-shaped head portion 122 backwards as the lid-engaging latch member 120 moves downwards. When the upper, generally flat portion 124 of the wedge-shaped head portion 122 moves just under the lower edge 114 of the generally vertical flange 112, the lid-engaging latch member 120 resiliently snaps back forwards until a generally vertical portion 128 of the wedge-shaped head portion 122 contacts a side of the generally vertical flange 112, and allows no further forward movement of the lid-engaging latch member 120. At this point, the positions of the upper, generally flat portion 124 of the wedge-shaped head portion 122 and the lower edge 114 of the generally vertical flange 112 prevent upward movement of the lid-engaging latch member 120, and therefore allow prevent disengagement of the push portion 70 from the lid portion 22. The widths of the lid-engaging latch member 120 and the generally vertical flange 112 are such that lateral movement of the push portion 70 relative to the lid portion 22 does not disengage the lid-engaging latch member 120 and the generally vertical flange 112.

The push portion 70 may include various indicia/text 200 including, but not limited to, the word "PUSH" formed into a generally vertical portion of the push portion 70 to convey to a user that the push portion 70 is to be pushed as part of disengaging the push portion 70 from the slide portion 80. The indicia/text 200 may be located at a preferred spot for the push portion 70 to be depressed by the user so as to move the generally vertical portion of the push portion 70 closer to the wall portion 38 of the lid portion 22.

The slide portion 80 directly mechanically engages the base portion 24 without additional fasteners. That is, the slide portion 80 engages the base portion 24 without the use of various additional fasteners including, but not limited to, mechanical fasteners (e.g., screws, nuts, washers, bolts, or the like), chemical fasteners (e.g., adhesives, or the like) or other types of fastening (e.g., laser welding, or the like). The base portion 24 include a generally T-shaped opening 130 in the wall portion 58 through which the latch cage 82, slide springs 88, a pair of base-engaging latch members 140 may be inserted. The wall portion 58 further includes a pair of generally horizontal flanges 132. Each base-engaging latch member 140 includes a wedge-shaped head portion 142. An inward, generally vertical portion 144 of each wedge-shaped head portion 142 is configured to engage an outward edge 134 of one of the generally horizontal flanges 132, as seen in FIGS. 4-8. When the base-engaging latch members 140 pass through the opening 130, an angled portion 146 of each base-engaging latch member 140 contacts a side of one of the generally horizontal flanges 132. Contact between the angled portion 146 and the generally horizontal flange 132 biases the wedge-shaped head portion 142 upwards as the base-engaging latch member 140 moves inwards. When the inward, generally vertical portion 144 of the wedge-shaped head portion 142 moves just past the outward edge 134 of the generally horizontal flange 132, the base-engaging latch member 140 resiliently snaps back downwards until a generally horizontal portion 148 of the wedge-shaped head portion 142 contacts a side of the generally horizontal flange 132, and allows no further downward movement of the base-engaging latch member 140. At this point, the positions of the inward, generally vertical portion 144 of the wedge-shaped head portion 142 and the outward edge 134 of the generally horizontal flange 132 prevent backward movement of the base-engaging latch member 140, and therefore allow prevent disengagement of the slide portion 80 from the base portion 24. The widths of the base-engaging latch member 140 and the generally horizontal flange 132 are such that lateral movement of the slide portion 80 relative to the base portion 24 does not disengage the base-engaging latch member 140 and the generally horizontal flange 132.

The slide portion 80 may include various indicia/text 300 including, but not limited to, the word "SLIDE" formed into a generally vertical portion of the slide portion 80 as well as a pair of oppositely face 'arrows' to convey to a user that the slide portion 80 is to be slid in either direction as part of disengaging the push portion 70 from the slide portion 80.

The push and slide portions 70, 80 are formed by various methods including, without limitation, injection molding, 3D printing (e.g., stereolithography (SLA), fused deposit modeling (FDM), etc.) or the like. The push and slide portions 70, 80 are made from various materials including, without limitation, plastic (e.g., acrylonitrile butadiene styrene (ABS), polypropylene, etc.) or the like. The push and slide portions 70, 80 may be made from the same material or from different materials. For example, the push portion 70 may be made from ABS while the slide portion 80 may be made from polypropylene as ABS provides more flex to the push portion 70 while polypropylene (which is stiffer than ABS) provides more stiffness to the slide portion 80.

As outlined above, the lid and base portions 22, 24 hingedly engage each other, and are rotatable relative to one another between the closed configuration and the open configuration. The lid and base portions 22, 24 are hingedly connected by a hinge mechanism 26. The hinge mechanism 26 includes two (2) flaps 150 die-cut and formed into a clamp shape from the wall portion 60 of the base portion 24. The hinge mechanism 26 further includes two (2) openings 152 die-cut into the wall portion 40 of the lid portion 22 through which the flaps 150 are inserted such that the lid portion 22 is engaged to the base portion 24 (and rotatable relative thereto) by being clamped into the flaps 150. In the alternative, the lid and base portions 22, 24 may be hingedly connected by an axle passing through sleeves formed from the lid and base portions 22, 24, whereby the lid and base portions 22, 24 are rotatable relative to each other about the axle. The lid and base portions 22, 24 may be made from various materials including, but not limited to, metal, plastic, and the like.

In the alternative, the base portion 24 may include a number of generally vertically-oriented dividers for defining a number of storage sections in the internal compartment 46. For example, a single divider may be laterally-oriented and extend between two opposing wall portions 58, 60 or longitudinally-oriented and extend between two opposing wall portions 54, 56. A single divider can separate the single storage section 62 of the base portion 24 into a pair of storage sections. The height of the divider can be less than or equal to the height of the wall portions 54, 56, 58, 60. Two or more dividers can be used to separate the storage section 62 into any number of smaller storage sections (limited only by the space available to do so). For example, a single laterally-oriented divider extending between two opposing wall portions 58, 60 and a single longitudinally-oriented divider extending between two opposing wall portions 54, 56 separate the storage section 62 into four (4) smaller storage sections. The more dividers used, the more storage sections that can be formed.

In use, a user holds the container assembly 20 with both hands. One of the user's hands pushes the push portion 70 inwards while the other hand slides the slide portion 80 in a first or second direction. The user then rotates the lid portion 22 upwardly away from the base portion 24, thereby moving the container assembly 20 from the closed configuration into the open configuration, and providing access to the internal compartment 46. If the user only pushes the push portion 70 but does not slide the slide portion 80, the latch mechanism 28 will not disengage, and the container assembly 20 will not open. Likewise, if the user only slides the slide portion 80, but does not push the push portion 70, the latch mechanism 28 will not disengage, and the container assembly 20 will not open. The user then moves the container assembly 20 from the open configuration to the closed configuration by rotating the lid portion 22 towards the closed configuration, with the angled portions 78, 94 coming into contact and guiding the push and slide portions 70, 80 to re-engage (without having to push the push portion 70 or slide the slide portion 80).

Although the present invention has been discussed above in connection with use in a container for medications, the present invention is not limited to that environment and may also be used in connection with other storage needs.

In addition, the claimed invention is not limited in size and may be constructed in miniature versions or for use in very large-scale applications in which the same or similar principles of motion and friction control as described above would apply. Likewise, various dimensions (e.g., length, width, height, etc.) of the container assembly are not to be construed as drawn to scale, and that the lengths/widths of the container assembly may be adjusted in conformance with a desired size. Furthermore, the figures (and various components shown therein) of the specification are not to be construed as drawn to scale.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "front," "rear," "left," "right," "inner," "outer," "beneath", "below", "lower", "above", "upper," "horizontal," "vertical" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The above description presents the best mode contemplated for carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above that are fully equivalent. Consequently, this invention is not limited to the particular embodiments disclosed. On the contrary, this invention covers all modifications and alternate constructions coming within the spirit and scope of the invention as generally expressed by the following claims, which particularly point out and distinctly claim the subject matter of the invention.

What is claimed is:

1. A container assembly, comprising:

a first portion including a first latch portion; and a second portion including a second latch portion;

wherein the first and second portions are movable between an open configuration and a closed configuration, and the first and second latch portions are releasably engaged in the closed configuration;

wherein the first and second latch portions engage the first and second portions together in the closed configuration to define an internal compartment;

and wherein the second latch portion includes a latch cage defining a chamber to receive a portion of the first latch portion in the closed configuration;

wherein the second latch portion further includes a pair of biasing arms each comprising a head portion engaged to a groove of the second portion to bias the second latch portion to an engagement position.

2. The container assembly of claim 1, wherein the portion of the first latch portion includes a latch member engaged to a portion of the second latch portion within the latch cage when the second latch portion is in an engagement position.

3. The container assembly of claim 1, wherein the second latch portion is slideably moveable in a first direction between the engagement position and a first disengagement position when the first and second portions are in the closed configuration.

4. The container assembly of claim 3, wherein the second latch portion is slideably moveable in a second direction between the engagement position and a second disengagement position when the first and second portions are in the closed configuration, wherein the second direction is opposite the first direction.

5. The container assembly of claim 1, wherein the second latch portion is slideably moveable between a first position and a second position when the first and second portions are in the closed configuration, whereby the second latch portion engages the first latch portion in the first position, thereby holding the first and second portions in the closed configuration, and the second and first latch portions are disengaged in the second position, thereby allowing the first and second portions to move from the closed configuration to the open configuration.

6. The container assembly of claim 1, wherein the first latch portion is moveable between a first position and a second position when the first and second portions are in the closed configuration, whereby the first latch portion engages the second latch portion in the first position, thereby holding the first and second portions in the closed configuration.

7. The container assembly of claim 6, wherein the first and second latch portions are disengaged in the second position of the first latch portion when the second latch portion is moved from a first position of the second latch portion, wherein the first and second latch portions are engaged, to a second position of the second latch portion, wherein the first and second latch portions are disengaged, thereby allowing the first and second portions to move from the closed configuration to the open configuration.

8. The container assembly of claim 1, wherein the first latch portion directly mechanically engages the first portion without additional fasteners.

9. The container assembly of claim 1, wherein the second latch portion directly mechanically engages the second portion without additional fasteners.

* * * * *